US007946865B1

(12) United States Patent
Lai

(10) Patent No.: US 7,946,865 B1
(45) Date of Patent: May 24, 2011

(54) CONNECTOR PICK-UP COVER

(75) Inventor: Ming-Chun Lai, Tu-Cheng (TW)

(73) Assignee: Cheng UEI Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/830,271

(22) Filed: Jul. 2, 2010

(51) Int. Cl.
*H01R 13/44* (2006.01)

(52) U.S. Cl. ..... 439/135; 439/41

(58) Field of Classification Search ..... 439/41, 439/135, 136, 137, 940
See application file for complete search history.

(56) References Cited

U.S. PATENT DOCUMENTS 5,026,295 A * 6/1991 Fong et al. ..... 439/135
5,361,492 A * 11/1994 Miyazawa ..... 29/879
6,599,140 B1 * 7/2003 Chen et al. ..... 439/135
6,945,799 B2 * 9/2005 Huang ..... 439/135
7,661,968 B1 * 2/2010 Duan et al. ..... 439/135
7,866,990 B2 * 1/2011 Liao ..... 439/135

* cited by examiner

*Primary Examiner* — Thanh-Tam T Le
(74) *Attorney, Agent, or Firm* — Cheng-Ju Chiang

(57) ABSTRACT

A pick-up cover adapted to be mounted to a connector which includes an L-shaped insulating body with a base body and a prop body perpendicularly extending upward, includes a pick-up board mounted on the connector, two clipping boards extending downward from two opposite ends of the pick-up board to clip the insulating body therebetween, and prop boards protruding downward from a front of a bottom surface of the pick-up board and abutting on the base body to strengthen the pick-up board. The pick-up board has a flat top surface for the convenience of the pick-up cover being picked up by a SMT machine. A bottom edge of the clipping board protrudes inward to form a locating barb buckled in an end outside of the base body. A locating portion protrudes at an inside of the clipping board and abuts against an end of a rear surface of the prop body.

4 Claims, 3 Drawing Sheets

CONNECTOR PICK-UP COVER

BACKGROUND OF THE INVENTION

1. Field of the Invention

The present invention generally relates to a connector pick-up cover, and more particularly to a connector pick-up cover adapted to be mounted to a connector for assisting the connector to be surface mounted onto a printed circuit board.

2. The Related Art

SMT (Surface Mounting Technology) machines utilizing vacuum pressure to pick-up connectors and then placing them onto a printed circuit board for soldering are well known in the electronic assembly art. However, the connector usually need make the picked-up surface flat so as to be picked up by the SMT machine. But at present, there are many connectors having uneven surfaces, so that results in the SMT machine unable of picking up the connectors. Finally the connectors cannot choose but be placed onto the printed circuit board by hand that reduces manufacture efficiency. Furthermore, during the process of surface-mounting, the connector will be apt to bias so that often results in an inferior engagement between the connector and the printed circuit board.

SUMMARY OF THE INVENTION

An object of the present invention is to provide a pick-up cover adapted to be mounted to a connector for assisting the connector to be picked up by a SMT machine and then surface mounted on a printed circuit board. The connector includes an insulating body and a plurality of terminals disposed in the insulating body. The insulating body is of substantial L-shape with a base body extending transversely and a prop body perpendicularly extending upward from a rear end of the base body. A pair of locating fillisters is opened at two opposite end outsides of the base body. The pick-up cover includes a pick-up board mounted on the connector with the top of the prop body being against a rear of a bottom surface of the pick-up board, two clipping boards perpendicularly extending downward from two opposite ends of the pick-up board to clip the insulating body of the connector therebetween, and a plurality of prop boards perpendicularly protruding downward from a front of the bottom surface of the pick-up board and arranged at regular intervals along a transverse direction thereof. The pick-up board has a flat top surface for the convenience of the pick-up cover being picked up by the SMT machine. A bottom edge of the clipping board protrudes inward to form a locating barb buckled in the corresponding locating fillister. A locating portion protrudes at an inside of the clipping board and abuts against an end of a rear surface of the prop body. The prop boards abut on the base body to strengthen the pick-up board.

As described above, the pick-up cover of the present invention can be easily picked up by the SMT machine on account of the flat top surface so as to assist the connector to be surface-mounted onto the printed circuit board. Furthermore, the locating barb and the locating portion relatively abut against the insulating body to avoid the connector biasing and further improve the surface-mount efficiency. Moreover, the prop boards abut on the base body to strengthen the pick-up board and prevent the pick-up board deforming so that further ensures the pick-up cover steadily picked up by the SMT machine.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
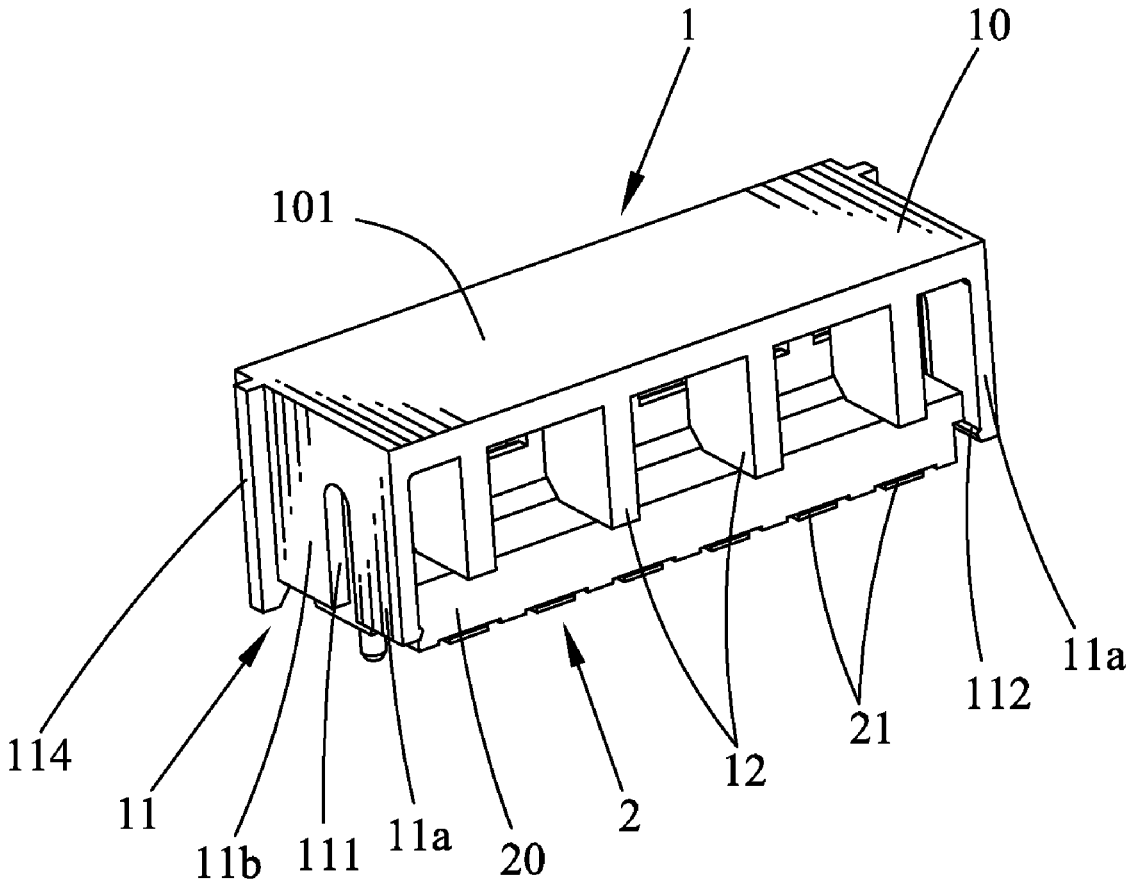
FIG. 1 is a perspective view showing that a connector pick-up cover of the present invention is mounted to a matching connector.

Referring to FIG. 1, a connector pick-up cover 1 in accordance with the present invention is adapted to be mounted to a matching connector 2 for assisting the connector 2 to be surface mounted on a printed circuit board.

Figure 2:
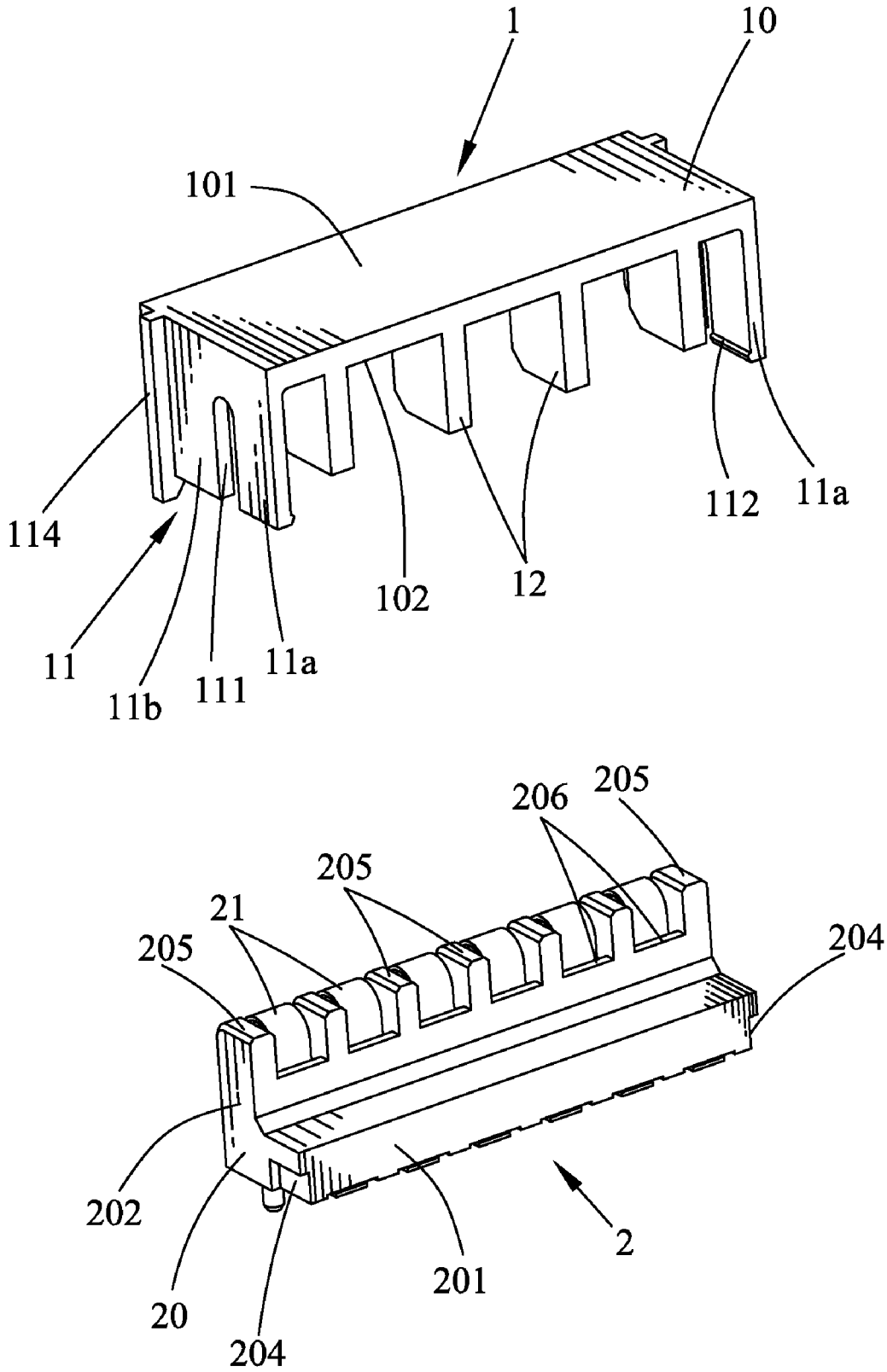
FIG. 2 is an exploded perspective view of FIG. 1.

Referring to FIG. 2, the connector 2 matched with the connector pick-up cover 1 of the present invention includes an insulating body 20 and a plurality of terminals 21 disposed in the insulating body 20. The insulating body 20 is of substantial L-shape from a lateral view, and has a long base body 201 extending transversely and a prop body 202 vertically extending upward from a rear end of the base body 201. A pair of substantially rectangular locating fillisters 204 is opened at fronts of two opposite end outsides of the base body 201. A plurality of terminal cavities 206 are opened in a top of the prop body 202 and arranged at regular intervals along a transverse direction thereof to divide the top of the prop body 202 into a plurality of prop walls 205. The terminals 21 are mounted in the terminal cavities 206 respectively.

Figure 3:
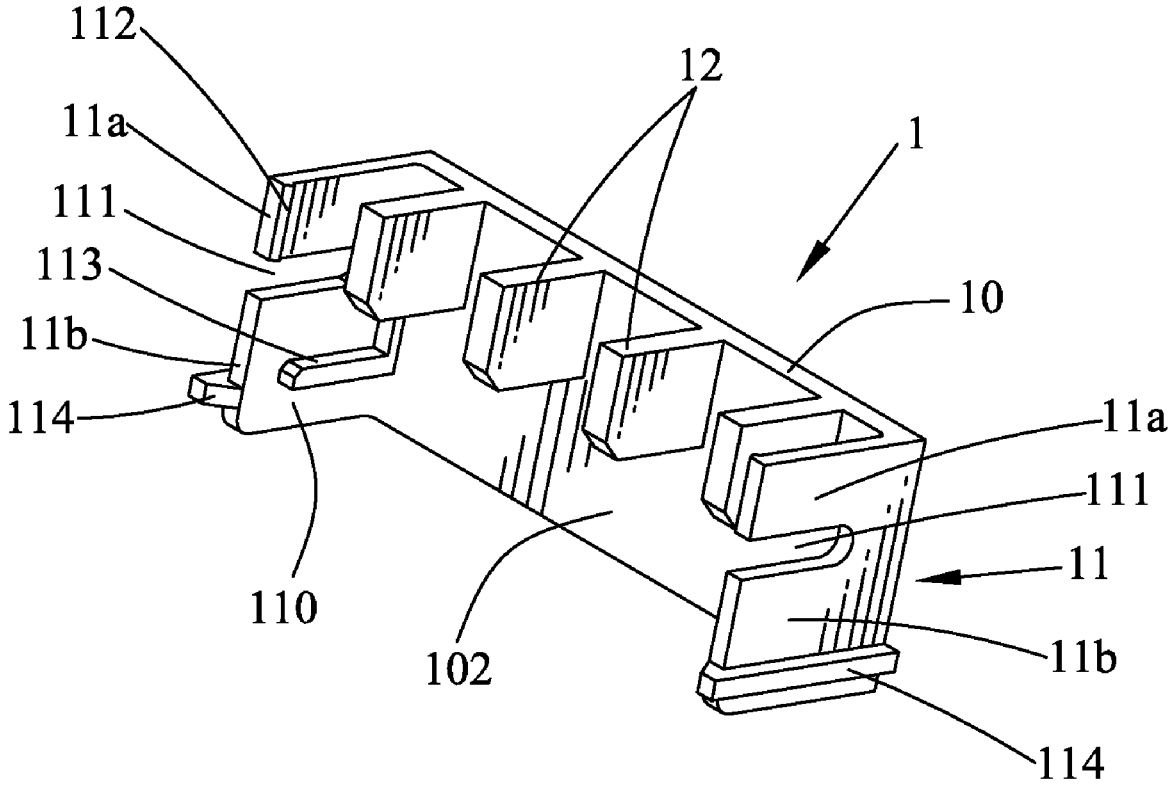
FIG. 3 is a perspective view of the connector pick-up cover of FIG. 1.

Referring to FIGS. 2 and 3, the connector pick-up cover 1 includes a rectangular pick-up board 10 having a flat top surface 101 for the convenience of the connector pick-up cover 1 being picked up by an external SMT machine. Two opposite ends of the pick-up board 10 perpendicularly extend downward to form a pair of rectangular clipping boards 11. A front of a bottom surface 102 of the pick-up board 10 perpendicularly protrudes downward to form a plurality of rectangular prop boards 12 arranged at regular intervals along a transverse direction thereof and each parallel to the clipping board 11. A slot 111 is vertically opened at a substantial middle of the clipping board 11, and penetrates through two opposite sides and a bottom of the clipping board 11 to divide the clipping board 11 into two parts which are designated as a first clipping board 11*a* at a front thereof and a second clipping board 11*b* at a rear thereof. A bottom edge of the first clipping board 11*a* protrudes inward to form a long locating barb 112 extending longitudinally. An L-shaped locating portion 113 is protruded at an inside surface 110 of the second clipping board 11*b*, and faces to the first clipping board 11*a*. One arm of the locating portion 113 is parallel to the locating barb 112. An outside of the second clipping board 11*b* protrudes outward to form a positioning portion 114 for facilitating the SMT machine to pick up the connector pick-up cover 1 by means of grabbing the positioning portions 114.

Referring to FIGS. 1-3, when the connector pick-up cover 1 is mounted to the connector 2, the insulating body 20 is clipped between the clipping boards 11 of the connector pick-up cover 1. The locating barbs 112 are buckled in the corresponding locating fillisters 204, and the locating portions 113 tightly wrap rear corners of two outmost prop walls 205, so that prevent the connector 2 biasing and ensure a steady engagement between the connector 2 and the connector pick-up cover 1. The prop boards 12 abut on the base body 201 and the prop walls 205 prop a rear of the bottom surface 102 of the pick-up board 10 of the connector pick-up cover 1 so that strengthen the pick-up board 10 to prevent the pick-up board 10 deforming under the pick-up of the SMT machine. So the top surface 101 of the pick-up board 10 can always keep flat to ensure that the connector pick-up cover 1 can be always picked up by the SMT machine.

As described above, the connector pick-up cover 1 of the present invention can be easily picked up by the SMT machine on account of the flat top surface 101 so as to assist the connector 2 to be surface-mounted onto the printed circuit board. Furthermore, the locating barb 112 and the locating portion 113 are designed to relatively fasten the insulating body 20 to avoid the connector 2 biasing and further improve the surface-mount efficiency. Moreover, the prop boards 12 abut on the base body 201 to strengthen the pick-up board 10 and prevent the pick-up board 10 deforming so that further ensures the connector pick-up cover 1 steadily picked up by the SMT machine.

What is claimed is:

1. A pick-up cover adapted to be mounted to a connector for assisting the connector to be picked up by a SMT machine and then surface mounted on a printed circuit board, the connector including an insulating body and a plurality of terminals disposed in the insulating body, the insulating body being of substantial L-shape with a base body extending transversely and a prop body perpendicularly extending upward from a rear end of the base body, a pair of locating fillisters being opened at two opposite end outsides of the base body, the pick-up cover comprising:

a pick-up board mounted on the connector with the top of the prop body being against a rear of a bottom surface of the pick-up board, the pick-up board having a flat top surface for the convenience of the pick-up cover being picked up by the SMT machine;

two clipping boards perpendicularly extending downward from two opposite ends of the pick-up board to clip the insulating body of the connector therebetween, a bottom edge of the clipping board protruding inward to form a locating barb buckled in the corresponding locating fillister, a locating portion protruding at an inside of the clipping board and abutting against an end of a rear surface of the prop body; and a plurality of prop boards perpendicularly protruding downward from a front of the bottom surface of the pick-up board and arranged at regular intervals along a transverse direction thereof, the prop boards abutting on the base body to strengthen the pick-up board.

2. The pick-up cover as claimed in claim 1, wherein a slot is vertically opened in the clipping board and penetrates through two opposite sides and a bottom of the clipping board to divide the clipping board into two parts which are designated as a first clipping board at a front thereof and a second clipping board at a rear thereof, the locating barb is formed at a bottom edge of the first clipping board and the locating portion is formed at an inside surface of the second clipping board.

3. The pick-up cover as claimed in claim 2, wherein the locating barb is of long strip shape extending longitudinally, the locating portion is of L-shape with one arm being parallel to the locating barb and faces to the first clipping board to wrap a rear corner of one end of the prop body.

4. The pick-up cover as claimed in claim 1, wherein an outside of the clipping board protrudes outward to form a positioning portion for facilitating the SMT machine to pick up the pick-up cover by means of grabbing the positioning portions.

* * * * *